US007131820B2

(12) United States Patent
Benckert

(10) Patent No.: US 7,131,820 B2
(45) Date of Patent: Nov. 7, 2006

(54) METHOD FOR CONTROLLING A THICK MATTER PUMP

(75) Inventor: Hartmut Benckert, Filderstadt (DE)

(73) Assignee: Putzmeister Aktiengesellschaft, Aichtal (DE)

( * ) Notice: Subject to any disclaimer, the term of this patent is extended or adjusted under 35 U.S.C. 154(b) by 209 days.

(21) Appl. No.: 10/476,106

(22) PCT Filed: Jul. 4, 2002

(86) PCT No.: PCT/EP02/07397

§ 371 (c)(1),
(2), (4) Date: Oct. 24, 2003

(87) PCT Pub. No.: WO03/019007

PCT Pub. Date: Mar. 6, 2003

(65) Prior Publication Data

US 2004/0146412 A1 Jul. 29, 2004

(30) Foreign Application Priority Data

Aug. 22, 2001 (DE) ..... 101 40 193

(51) Int. Cl.
*F04B 49/00* (2006.01)

(52) U.S. Cl. ..... 417/212; 417/290; 417/305; 417/517; 417/531; 417/532; 417/533; 417/534; 417/900; 417/516

(58) Field of Classification Search ..... 417/900, 417/533, 534, 539, 532, 531, 516, 12, 212
See application file for complete search history.

(56) References Cited

U.S. PATENT DOCUMENTS 3,963,385 A * 6/1976 Caban ..... 417/517
5,180,294 A * 1/1993 Watchorn ..... 417/516
5,190,449 A 3/1993 Dose et al.
5,865,606 A * 2/1999 Huang ..... 417/532

FOREIGN PATENT DOCUMENTS

DE 2 039 854 2/1972

(Continued)

*Primary Examiner*—Tae Jun Kim
*Assistant Examiner*—Ryan Gillan
(74) *Attorney, Agent, or Firm*—Akerman & Senterfitt; Stephan A. Pendorf

(57) ABSTRACT

A method for controlling a thick matter pump comprising two delivery cylinders (10) emerging, via two openings (12), into a material reservoir (14), associated with two delivery pistons (26), symmetrically synchronized relative to said cylinders, and a branch pipe 18 arranged inside the material reservoir (14), capable of being connected, on the input side, alternatively to one of the openings of the delivery cylinders with exposing of the other opening, the output side connected to a conveyance conduit (20). When the pumping is interrupted, thick matter, liquid concrete for example, is sucked up, via the delivery cylinder temporarily communicating with the reservoir, and is delivered, via the other cylinder (10), connected to the branch pipe (18), so as to form a column of thick matter through the delivery pipe (20), towards its output. In order to avoid problems of deposit, condensation and solidification, the invention is characterized in that the thick matter column is maintained, at least temporarily, in movement, when pumping is interrupted, in the delivery pipe (20) and/or the branch pipe (18) and/or the delivery cylinders (10), while not allowing the thick matter to escape from said delivery pipe (20) on the output side. The invention is further characterized in that, when the pumping is stopped, the thick matter in the matter reservoir is maintained in movement by the back and forth oscillation of the feeding pipe (18) and/or at least one stirrer (34).

19 Claims, 1 Drawing Sheet

FOREIGN PATENT DOCUMENTS

| | | |
|---|---|---|
| DE | 2 161 025 | 5/1973 |
| DE | 196 43 038 A1 | 4/1998 |
| DE | 196 53 636 A1 | 6/1998 |
| DE | 299 04 624 U1 | 7/1999 |

* cited by examiner

METHOD FOR CONTROLLING A THICK MATTER PUMP

CROSS REFERENCE TO RELATED APPLICATION

This application is a national stage of PCT/EP02/07397 filed Jul. 4, 2002 and based upon DE 101 40 193.0 filed Aug. 22, 2001 under the International Convention.

BACKGROUND OF THE INVENTION

1. Field of the Invention

The invention concerns a method for controlling a thick matter pump, which comprises two conveyance cylinders with openings in communication with a material reservoir and with conveyance pistons operated in counterstroke, as well as a branch pipe provided within the material reservoir and having its inlet alternatingly in communication with the openings of the conveyance cylinders while leaving open the respective other opening and having its outlet in communication with the conveyance conduit, wherein during pumping operations thick matter is sucked from the material reservoir into the open conveyance cylinder and pumped via the other conveyance cylinder temporarily in communication with the branch pipe to the outlet conveyance conduit with building up of a thick matter column in the conveyance conduit.

2. Description of the Related Art

Although thick matter pumps of this type are suitable for conveyance of various types of pumpable thick material, additional considerable technical and economic factors are involved in the conveyance of liquid concrete. The following embodiments are thus directed specifically to the conveyance of liquid concrete, but it should be understood that the invention is not thereby being limited thereto.

Thick matter pumps can be provided on stationary or mobile frameworks. Primarily in mobile concrete pumps the conveyance conduit is directed along a distribution boom which may be an articulated boom and includes a terminal hose in the area of its outlet. The material reservoir of the concrete pump is conventionally supplied with liquid concrete via a mobile concrete mixer. During the waiting time, while waiting for the next mobile cement mixer or during repositioning of the distribution boom to a different application location, the pumps are routinely paused, and the concrete pump is out of operation. At this time there is concern that the concrete which is at rest can begin setting or hardening. This applies in particular in the case of self-hardening concretes, in which a self-hardening from below builds up as a result of the off-gassing of air pores. During the pausing of the pumping there are thus undesired occurrences of hardening of concrete both in the conveyance system as well as in the material reservoir.

SUMMARY OF THE INVENTION

Beginning therewith, it is the task of the present invention to develop a method for controlling a thick matter pump in which an undesired solidification of the thick matter during pausing of the pump can be avoided.

The solution of this task is proposed in accordance with the combination of characteristics set forth in patent claim 1. Advantageous embodiments and further developments of the invention can be seen from the dependent claims.

The inventive solution is based upon the idea, that the hardening of preferably self-setting thick matter, such as liquid concrete, can be prevented thereby that the thick matter is maintained in motion even during pausing of the pumping. In accordance therewith, it is proposed in accordance with the invention that, during a pausing of the pumping, the thick matter column is maintained at least temporarily in motion in the conveyance conduit and/or the branch pipe and/or the conveyance cylinders, without however thick matter exiting from the outlet side of the conveyance conduit. This is preferably achieved thereby, that during the pausing of the pumping the conveyance pistons and/or the branch pipe are operated for producing an alternating back and forth movement of the thick matter column. The main amount of the thick matter can remain in the conveyance conduit system in this manner of operation until the next pumping operation phase. Even during prolonged periods of down time, no emptying of the conveyance conduit is necessary.

In order to ensure that the main part of the thick matter remains in the conveyance conduit system, it is proposed in accordance with a preferred embodiment of the invention:

- that at the onset of the pausing of pumping, from a temporary resting condition thick matter is first sucked out of the conveyance conduit by a backwards stroke of the piston of the conveyance cylinder which is at this time in communication with the branch pipe,
- that, subsequent to the first backwards stroke, the branch pipe is switched over to the other conveyance cylinder and thick matter is suctioned out of the conveyance conduit by a backwards stroke of this piston,
- that, following the last backwards stroke, the branch pipe is switched over to the respective other conveyance cylinder and thick matter is pushed in a forwards stroke by this piston into the conveyance conduit, without it exiting the outlet side of the conveyance conduit,
- that, subsequent to the first forwards stroke, the branch pipe is switched over to the respective other conveyance cylinder and thick matter is pushed by this piston in a forwards stroke into the conveyance conduit, without it exiting at the outlet side of the conveyance conduit,
- that, subsequent to the last forwards stroke, thick matter is suctioned out of the conveyance conduit in a backwards stroke without switching over of the branch pipe,
- that the above sequence of movements are repeated during pausing of pumping in the manner of a cyclical control sequence.

The forward and backward stroke carried out during the pausing of the pumping can extend either over a part of the cylinder length or over the entire cylinder length. It is basically also possible to carryout multiple backwards and forwards strokes sequentially without switching over of the branch pipe. At each pausing of the pumping the outlet end of the conveyance conduit should be lifted to the extent that no thick matter can flow out of the outlet end under the influence of gravity.

In order to prevent a self-hardening or self-setting of the thick matter in the material reservoir, it is proposed in accordance with a further embodiment of the invention that during the pumping phase the thick matter in the material reservoir is kept in motion in the material reservoir by the back and forth movement of the branch pipe and/or at least one stirrer or mixer. The direction of rotation of the stirrer located in the material reservoir can be reversed periodically or stochatistically preferably in coincidence with the piston strokes. It is basically possible that during the pausing of the pumps additional stirring means engaging in the material reservoir are placed into operation preferably with alternating direction of rotation.

In the case that during a pausing of pumping little or no thick matter is located in the conveyance conduit, a simplified mode of movement can be achieved thereby, that during pausing of the pumping the branch pipe is pivoted into the intermediate position with partial bridging-over between the two cylinder openings, and that the pistons are driven, preferably slower than in the case of pumping operation, in counterstroke. Therewith an effective agitation of the thick matter in the material reservoir and in the conveyance cylinders can be achieved, without causing a flow in the placement boom.

It is basically possible, to keep the thick matter in the conveyance conduit and in the branch part in motion also with mechanical means. This can occur thereby, that during the pausing of the pumps a stirring element is introduced into the conveyance conduit via a spring elastic shaft or an articulated shaft and with the aid of an external drive is driven axially or rotatingly. During a renewed pumping operation the stirring element can be removed again from the conveyance conduit.

BRIEF DESCRIPTION OF THE DRAWING

In the following the invention will be described in greater detail on the basis of an illustrative embodiment represented in schematic manner in the FIGURE.

The single FIGURE shows a two-cylinder concrete pump with partial sectional perspective representation.

DETAILED DESCRIPTION OF THE INVENTION

Figure 1:
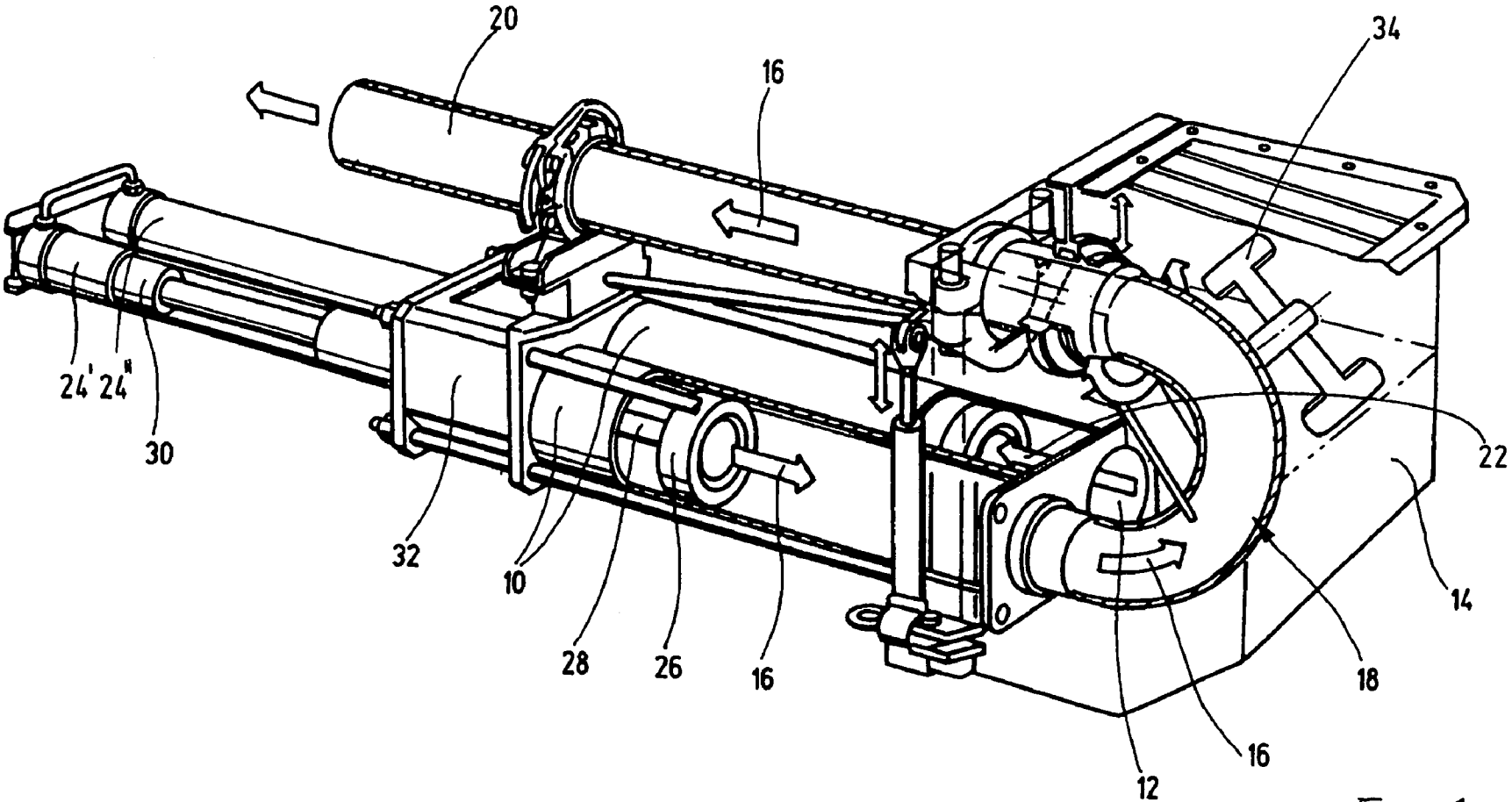

The concrete pump represented in the FIGURE is comprised essentially of two conveyance cylinders 10, of which openings 12 at one end are in communication with a material reservoir 14. In the material reservoir 14 there is a branch pipe 18, which on the inlet side is alternatingly in communication with openings 12 of the conveyance cylinders and on the outlet side is in communication with the conveyance conduit 20. The conveyor pistons 26 provided in the conveyor cylinders 10 are operated in counterstroke via hydraulic drive cylinders 24', 24". For this purpose the conveyance pistons 26 are connected via a common piston rod 28 with the drive pistons 30 of the drive cylinders 24', 24". In the area between the conveyance cylinders 10 and the drive cylinders 24', 24" there is a water chest 32, through which the piston rods 29 pass.

During pumping operation liquid concrete is suctioned through the conveyance cylinder 10 which is open at this time to the material reservoir 14 (arrow 22), and conveyed out through the other conveyance cylinder which is in communication with the branch pipe 18 and to the outlet with building up of a concrete column (arrow 16).

During pausing of the pumping, for example while waiting for the next mobile concrete mixer, there could result a hardening or setting of residual concrete in the entire system. This applies in particular to self-hardening concretes, which on the basis of off-gassing of air pores the concrete hardens from below. This undesired effect can be avoided when the entire concrete volume in the machine is kept in motion also during pausing of the pumps. This can occur by a suitable control of the concrete pump during pausing of pumping, which the pump operator can initiate for example via a remote control device. The agitation mode to be placed into operation in this manner during pump pausing envisions that the concrete column in the conveyance conduit 20 and/or the branch pipe 18 and/or the conveyance cylinders 10 are at least temporarily maintained in motion, without allowing liquid concrete to exit out of the outlet side of the conveyance conduit 20. This can be accomplished thereby, that during the pausing of the pump the conveyor pistons 26 and/or the branch pipe 18 are operated to produce an alternating back and forth movement of the concrete column. Further, during the pausing of the pumps, the liquid concrete can be maintained in motion also in the material reservoir 14 by the back and forward oscillation of the branch pipe 18 and/or at least one agitator or stirrer 34.

EXAMPLE 1

The mode of movement according to Example 1 envisions that at the beginning of a pausing of the pumping, beginning with a temporarily stationary condition, first concrete is suctioned out of the conveyance conduit 20 by a backwards stroke of the piston 26 of the conveyor cylinder 10 connected at this time to the branch pipe 18. Subsequent to this first backwards stroke the branch pipe 18 is switched to the other conveyor cylinder 10 and concrete is likewise suctioned out of the conveyance conduit 20 during a backwards stroke of this piston 26. Subsequent to the last backwards stroke the branch pipe can be switched to the respective other conveyor cylinder 10 and concrete can be pushed in a forwards stroke from this piston into the conveyance conduit 20. Subsequent to this first forward stroke, the branch pipe can switched over to the respective other conveyor cylinder and concrete can again be pushed by a forward stroke of this piston into the conveyance conduit. The two initial backwards strokes ensure that during the subsequent forward strokes no concrete emerges from the outlet side of the conveyance conduit. In order to ensure this also during subsequent strokes, subsequent to the last forward stroke, without switching over of the branch pipe 18, concrete is suctioned in the backwards stroke out of the conveyor line. The forwards and backwards stroke can be carried out for a period of time without switching over of the branch pipe 18 repeatedly. Thereby, the material entering and leaving the respective open conveyor cylinder produces a desired flowing movement in the material reservoir 14. The above sequence of movements can also repeated in a cyclic manner during the entire pausing of pumping, without occurrence of an exiting of concrete at the conveyance conduit outlet and without resulting in an overflow filling of the material reservoir. The continuous movement of the concrete volume ensures that the concrete cannot harden or set during pausing of the pumps.

EXAMPLE 2

During operation of the concrete pumps, it frequently occurs that liquid concrete remains in the material reservoir; the conveyance conduit and the branch pipe however have already been cleaned and are free of concrete. In this case it is important that the concrete remaining in the material reservoir and in the conveyor cylinders are kept in motion, without the concrete entering the conveyance conduit through the branch pipe. In order to accomplish this, there is proposed in accordance with a simplified movement mode according to Example 2 that during a pausing of the pumps the branch pipe is pivoted to an intermediate position with partial bridging between the two cylinder openings and that the piston is driven in counterstroke with maintaining movement of the concrete, preferably slower than during pumping operation. Thereby the concrete is oscillated back and forth in the funnel by the conveyor cylinders, without producing an undesired flow of concrete in the conveyance conduit.

EXAMPLE 3

For establishing movement of concrete within the conveyance conduit is it basically also possible to introduce a mechanical stirring element into the conveyance conduit. For this, a suitable opening is to be provided at the conveyance conduit, via which the stirring element is introduced for example via an articulated shaft or a spring-elastic shaft. An external drive then ensures that the stirring element is caused to be moved in either a rotating or an axially oscillating movement, so that movement is introduced into the resting concrete column. In the case of a renewed pumping operation the stirring element is then extracted from the conduit.

In summary the following can be concluded: The invention concerns a method for controlling a thick matter pump comprising two delivery cylinders 10 emerging, via two openings 12, into a material reservoir 14, associated with two delivery pistons 26, symmetrically synchronized relative to said cylinders, and a branch pipe 18 arranged inside the material reservoir 14, capable of being connected, on the input side, alternatively to one of the openings of the delivery cylinders with exposing of the other opening, the output side connected to a conveyance conduit 20. When the pumping is interrupted, thick matter, liquid concrete for example, is sucked up, via the delivery cylinder temporarily communicating with the reservoir, and is delivered, via the other cylinder 10, connected to the branch pipe 18, so as to form a column of thick matter through the delivery pipe 20, towards its output. In order to avoid problems of deposit, condensation and solidification, the invention is characterized in that the thick matter column is maintained, at least temporarily, in movement, when pumping is interrupted, in the delivery pipe 20 and/or the branch pipe 18 and/or the delivery cylinders 10, while not allowing the thick matter to escape from said delivery pipe 20 on the output side. The invention is further characterized in that, when the pumping is stopped, the thick matter in the matter reservoir is maintained in movement by the back and forth oscillation of the feeding pipe 18 and/or at least one stirrer 34.

The invention claimed is:

1. A process for controlling a thick matter pump, including two conveyor cylinders (10) communicating via openings (12) with a material reservoir (14) and with conveyor pistons (26) operated in counterstroke, as well as a pipe branch (18) provided within the material reservoir (14) connected on the inlet side alternative with one of the openings (12) of the conveyor cylinders with freeing of the respective other opening and on the outlet side connected with a conveyance conduit (20), in which thick matter is suctioned in during pump operation through the conveyor cylinder (10) which is open at the time towards the material reservoir (14) and is conveyed through the other conveyor cylinder (10) which is connected to the branch pipe (18) and through the conveyance conduit (20) with building up of a thick matter column towards the outlet thereof, wherein during a pausing of pumping the thick matter column in the conveyance conduit (20) and/or the branch pipe (18) and/or the conveyor cylinders (10) is at least temporarily maintained in motion by operating the conveyor piston (26) and/or the branch pipe (18) for producing an alternating back and forth movement of the thick matter column, without thick matter exiting from the outlet side of the conduit (20), wherein at the onset of pausing of pumping, starting with a temporarily resting condition, first thick matter is suctioned out of the conveyance conduit (20) by a backwards stroke of the piston (26) of the conveyor cylinder (10) connected at this time with the branch pipe (18), that subsequent to the first backwards stroke the branch pipe (18) is switched over to the other conveyor cylinder (10) and thick matter is suctioned out of the conveyance conduit (20) by a backwards stroke of its piston (26) and that subsequent to the last backwards stroke the branch pipe (18) is switched over to the respective other conveyor cylinder (10) and tick matter is pressed into the conveyance conduit (10) by a forwards stroke of its piston, without matter exiting from the outlet side of the conveyance conduit.

2. A process according to claim 1, wherein subsequent to the first forward stroke the branch pipe is switched over to the respective other conveyor cylinder and thick matter is pressed into the conveyance conduit by the forward stroke of this piston, without it exiting the outlet side of the conveyance conduit.

3. A process according to claim 1, wherein subsequent to a forward stroke thick matter is sucked out of the conveyance conduit in a backward stroke without switching of the branch pipe.

4. A process according to claim 1, wherein subsequent to a backwards stroke thick matter is pressed with forward stroke into the conveyance conduit (10) without switching over of the branch pipe, without it exiting the outlet side of the conveyance conduit.

5. A process according to claim 1, wherein the movement stroke is repeated cyclically during the pausing of the pumping in the manner of a sequential control.

6. A process according to claim 1, wherein during the pause in pumping the thick matter in the material reservoir (14) is kept in movement by the back and forth switching of the branch pipe (18) and/or at least one mixer (34).

7. A process according to claim 6, wherein the direction of rotation of the stirrer located in the material reservoir (14) is reversed periodically or stochastically.

8. A process according to claim 7, wherein the direction of rotation of the stirrer located in the material reservoir (14) is reversed periodically or stochastically in relationship to the piston stroke.

9. A process according to claim 1, wherein during the pausing of the pump supplemental stirrers engaging in the material reservoir are brought into operation.

10. A process according to claim 9, wherein during the pausing of the pump supplemental stirrers engaging in the material reservoir are brought into operation with alternating direction of rotation.

11. A process according to claim 1, wherein the forward and backward stroke carried out during the pausing of pumping extends over least a part of the length of the cylinder.

12. A process according to claim 1, wherein during the pause in pumping the branch pipe (18) is pivoted to an intermediate position wit partial bridging between the two cylinder openings (10), and that the piston (26) is controlled in counterstroke with bringing about a movement in the thick matter, preferably slower than in the case of a pumping operation.

13. A process according to claim 1, wherein the outlet end of the conveyance conduit, during pausing of pumping, is titled to the extent that no thick matter flows out of the outlet side under the influence of gravity.

14. A process according to claim 1, wherein said thick matter is concrete.

15. A process for controlling a thick matter pump, including two conveyor cylinders (10) communicating via openings (12) with a material reservoir (14) and with conveyor pistons (26) operated in counterstroke, as well as a pipe branch (18) provided within the material reservoir (14) connected on the inlet side alternative with one of the openings (12) of the conveyor cylinders with freeing of the respective other opening and on the outlet side connected with a conveyance conduit (20), in which thick matter is suctioned in during pump operation through the conveyor cylinder (10) which is open at the time towards the material reservoir (14) and is conveyed through the other conveyor cylinder (10) which is connected to the branch pipe (18) and through the conveyance conduit (20) with building up of a thick matter column towards the outlet thereof, wherein during a pausing of pumping the thick matter column in the conveyance conduit (20) and/or the branch pipe (18) and/or the conveyor cylinders (10) is at least temporarily maintained in motion by operating the conveyor piston (26) and/or the branch pipe (18) for producing an alternating back and forth movement of the thick matter column, without thick matter exiting from the outlet side of the conduit (20).

16. A process according to claim 15, wherein during the pausing of pumping a mechanical stirring element is introduced into the conveyor line that causes movement within the thick matter column present therein.

17. A process according to claim 15, wherein said thick matter is concrete.

18. A process for controlling a thick matter pump, including two conveyor cylinders (10) communicating via openings (12) with a material reservoir (14) and with conveyor pistons (26) operated in counterstroke, as well as a pipe branch (18) provided within the material reservoir (14) connected on the inlet side alternative with one of the openings (12) of the conveyor cylinders with freeing of the respective other opening and on the outlet side connected with a conveyance conduit (20), in which thick matter is suctioned in during pump operation through the conveyor cylinder (10) which is open at the time towards the material reservoir (14) and is conveyed through the other conveyor cylinder (10) which is connected to the branch pipe (18) and through the conveyance conduit (20) with building up of a thick matter column towards the outlet thereof, wherein during a pausing of pumping the thick matter column in the conveyance conduit (20) and/or the branch pipe (18) and/or the conveyor cylinders (10) is at least temporarily maintained in motion by operating the conveyor piston (26) and/or the branch pipe (18) for producing an alternating back and forth movement of the thick matter column, without thick matter exiting from the outlet side of the conduit (20), wherein the stirring element is provided on an articulated shaft or string elastic shaft associated with a rotation and/or push drive.

19. A process according to claim 18, wherein said thick matter is concrete.

* * * * *